United States Patent [19]

Segafredo

[11] 4,220,095

[45] Sep. 2, 1980

[54] OVERHEAD CABLE TRANSPORT INSTALLATION WITH A DEVICE FOR MONITORING THE COMPONENTS SUPPORTING THE CABLE

[75] Inventor: André J. Segafredo, Seyssinet-Pariset, France

[73] Assignee: S.A. Pomagalski, France

[21] Appl. No.: 897,270

[22] Filed: Apr. 18, 1978

[30] Foreign Application Priority Data

Apr. 22, 1977 [FR] France ..... 77 14159
Feb. 1, 1978 [FR] France ..... 78 03304

[51] Int. Cl.[3] ..... B61B 12/06
[52] U.S. Cl. ..... 104/179; 104/173 ST; 200/61.08
[58] Field of Search ..... 104/179, 178, 115, 112, 104/173 ST; 200/61.08, 61.18

[56] References Cited

U.S. PATENT DOCUMENTS

| | | | |
|---|---|---|---|
| 3,003,045 | 10/1961 | Tichenor | 200/61.08 |
| 3,347,172 | 10/1967 | Sowder | 104/173 ST |
| 4,003,314 | 1/1977 | Pearson | 104/179 |
| 4,019,002 | 4/1977 | Kunczynski | 104/178 |
| 4,074,094 | 2/1978 | Lubbe | 200/61.18 |

FOREIGN PATENT DOCUMENTS

| | | | |
|---|---|---|---|
| 2355294 | 5/1974 | Fed. Rep. of Germany | 104/179 |

*Primary Examiner*—John J. Love
*Assistant Examiner*—Ross Weaver
*Attorney, Agent, or Firm*—Stevens, Davis, Miller & Mosher

[57] ABSTRACT

Transport installation with overhead cable and device for monitoring the cable-supporting components. With each rocker is associated a conductor wire sectioning device for cutting the safety line and extending over the length of the train of sheaves. The sectioning may be brought about by the unlatching of a spring acting on a shear in case of excessive pivoting of the rocker or a derailment of the cable.

4 Claims, 8 Drawing Figures

OVERHEAD CABLE TRANSPORT INSTALLATION WITH A DEVICE FOR MONITORING THE COMPONENTS SUPPORTING THE CABLE

The invention relates to an overhead cable transport installation with a device for monitoring the components supporting the cable, comprising:

a train of successive rockers, each rocker having two cable support sheaves and a spindle on which the rocker is articulated, a safety device for the detection of a derailment of the cable or an excessive pivoting of the rocker around the spindle, said safety device having an electric line over the length of the installation and a means for signaling an interruption in the electric line.

A known device of the sort mentioned has a brittle bar stretching transversely to the trajectories of the cable upon falling and the support rocker when pivoting. A weight putting the rocker out of balance causes the tipping of the rocker upon derailment of the cable and breaks the bar if this has not been broken by the fall of the cable. This device does not permit the monitoring of the integrality of the whole of the components of a train of rockers and more particularly the detection of the loss of a sheave as a result of the shearing of its spindle, because the equipping of each rocker with a brittle bar device of the type previously mentioned, or by any electrical switch device would multiply the number of electrical switches submitted to inclement weather conditions and the risk of untimely and needless stopping of the installation.

The object of the present invention is to remedy this disadvantage and to permit the devising of a simple and reliable safety device that is suitable for adaptation to existing installations.

The present invention is distinguished by a conductor wire inserted electrically in series in the said safety line and running along the train of rockers, and the means of sectioning said conductor wire associated with the successive rockers of the said train to section the wire and interrupt the safety line on the occasion of a derailment of the cable or excessive tipping of a rocker.

An electrical conductor belonging to the safety line of the installation runs along the train of rockers and works in conjunction with a plurality of successive rockers, in such manner as to be interrupted by shearing or breaking by traction on the excessive tipping of one of the rockers. The flexible conductor may have a slight slack to permit the normal movement of the rockers, so as to be broken only in case of excessive tipping, due for example to the loss of a sheave. A shearing device, one of the shanks of which is fixed to the rocker monitored, advantageously facilitates the breaking and interruption of the conductor.

According to a development of the invention, the energy for sectioning the conductor wire is furnished by an energy-accumulator, notably a spring, locked in the set position by a latch. The falling of the cable or the excessive tipping of the rocker unlocks the latch and frees the stored energy to cut the wire. The tipping force is low and any risk of partial cutting is avoided.

The loss of a sheave is an example of an incident detected, but it is clear that the loss of a complete rocker or the breaking of a side plate is also detected.

When the cable derailment detectors are mounted at the entrance to and the exit from the train of rockers, it is advantageous to connect electrically the ends of the sectionable electrical conductor to these detectors, so that this conductor forms the part of the safety line along the rocker.

When checking the correct operation, it is of course necessary to avoid cutting the wire or the line, which would soon have an intolerable number of splices. In accordance with an important point of the present invention, the safety line conductor is looped in the shear of the safety device, so as to permit the withdrawal of this loop from the shear, and the testing of the correct operation of the safety device in the absence of the line conductor which can advantageously be replaced by a length of identical conductor independent of the line. When the shear operates it cuts a section of the safety line and the ejection of this section can be ensured by means of an elastic device confirming the sectioning of the line.

Other advantages and features of the invention will be brought out more clearly from the following description of the various modes of application of the invention, given as non restrictive examples and shown in the annexed drawings, in which.

Figure 1:
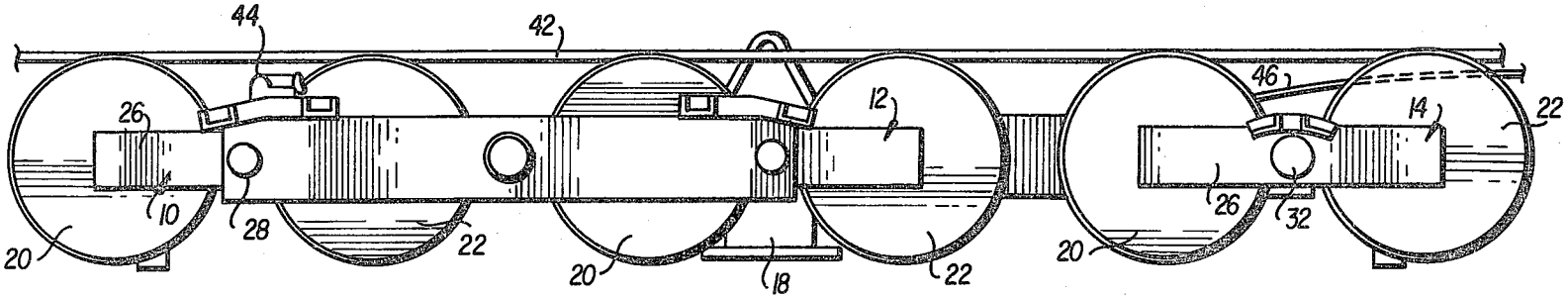
FIG. 1 is a view in elevation of a train of cable support rockers equipped with a detector in accordance with the invention.
Figure 2:
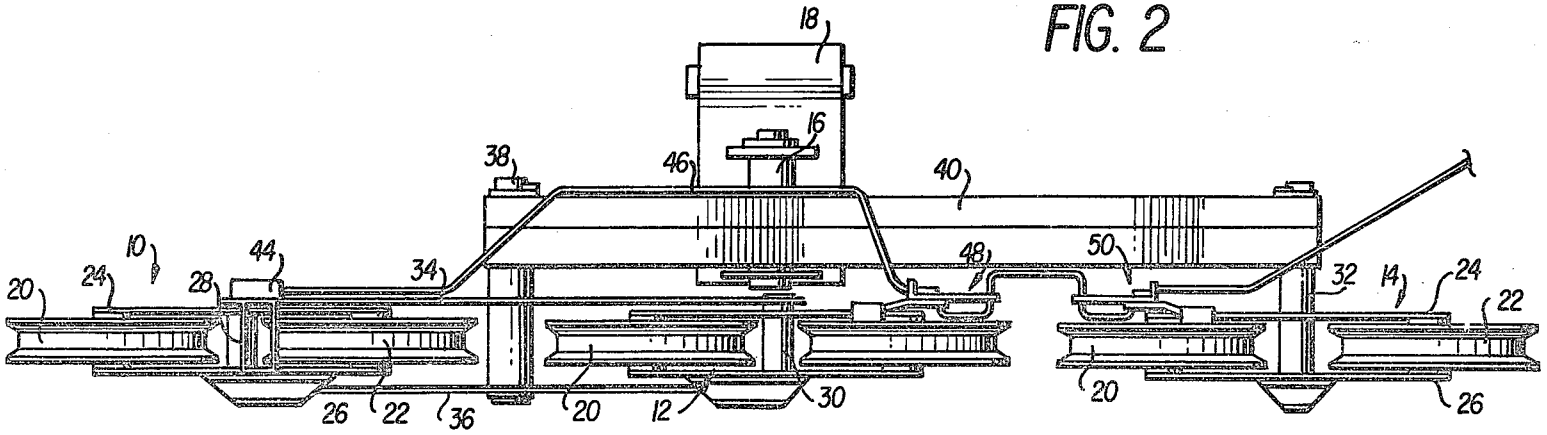
FIG. 2 is a view in plan of FIG. 1.

In FIGS. 1 to 4, a train of rockers with three rocker elements 10, 12, 14 is articulated on a support spindle 16 carried by a tower 18. Each of the rockers 10, 12, 14 has a pair of sheaves 20, 22, mounted on side plates 24, 26 forming a yoke articulated in the middle on a spindle 28, 30, 32 respectively.

The rockers are connected by side plates 34, 36, articulated on a spindle 38, the latter being fixed on the end of a beam 40, articulated on spindle 16 and having at the opposite end the spindle 32 of rocker 14. Such support or compression rockers for a cable 42 are well known to specialists and can comprise a different number of elements.

With rocker 10, mounted at the entrance to the train of rockers, is associated a derailment detector 44 of cable 42, for example of the brittle bar type, which detects at the same time the falling of the cable 42 and an excessive pivoting of the rocker 10. The detector 44 is inserted in an electrical safety line 46, which runs over the length of an installation, in particular a gondola lift, a cable car, chairlift or skilift, so as to signal the derailment of the cable and bring about the stopping of the installation. A second detector may be mounted at the exit from the train of rockers or at other appropriate positions.

Figure 3:
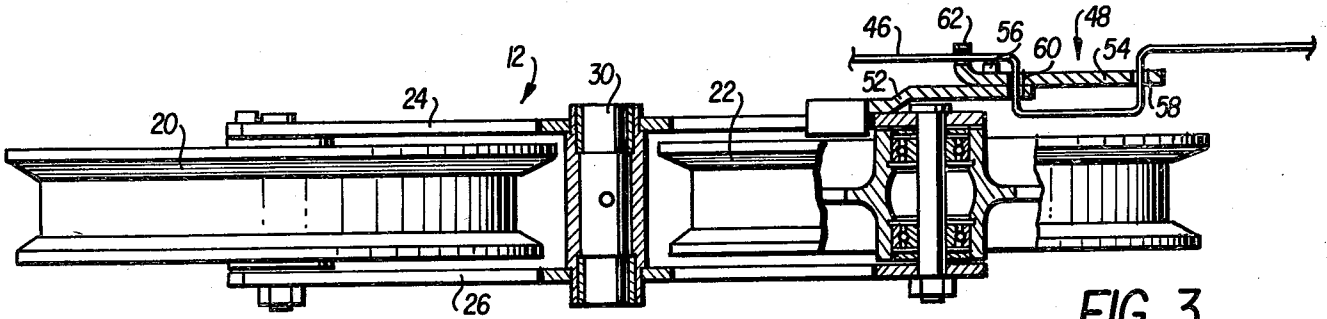
FIG. 3 is a partial view of FIG. 2, on an enlarged scale.
Figure 4:
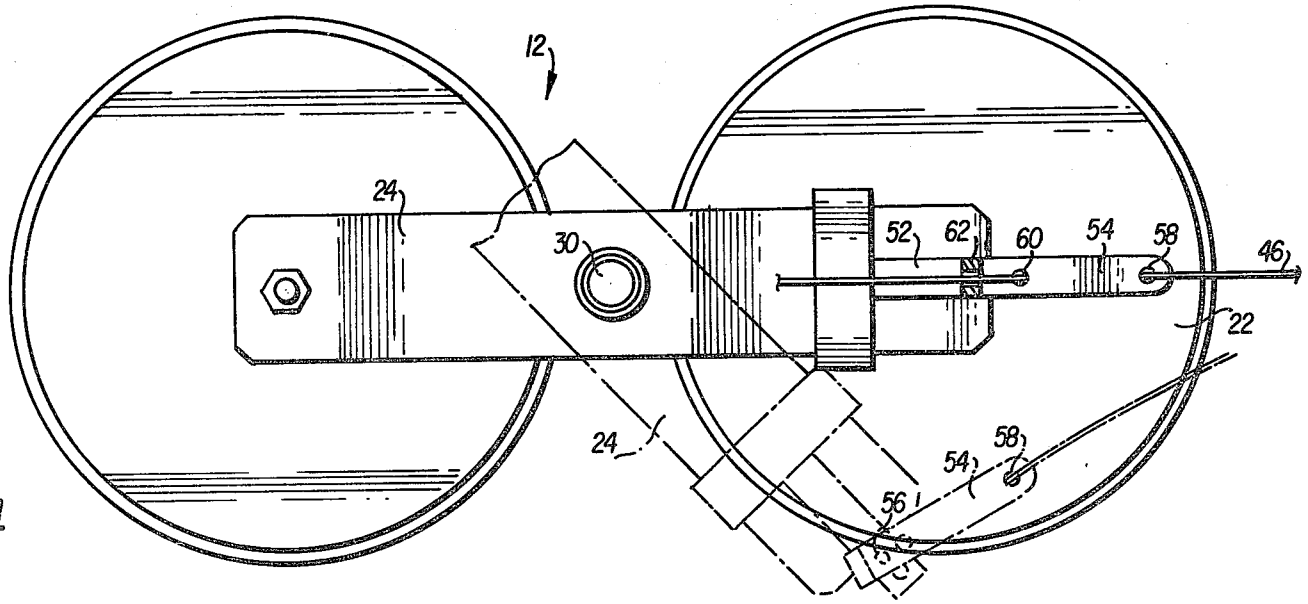
FIG. 4 is a rear view of FIG. 3.

With each rocker 12, 14, not protected by a brittle bar, is associated a detector of excessive pivoting or movement 48, 50 one of which 48 is described below most particularly with reference to FIGS. 3 and 4, the other detectors being identical. To side-plate 24 is fixed rigidly near one of the ends, for example by a screw (not shown), a pawl 52 extending in parallel with cable 12 and on which is articulated at 56 a bar 54 which in its normal position extends pawl 52. The safety line conductor 46 is threaded successively through a hole 58 at the free end of bar 54, a pair of holes 60 aligned with bar 54 and pawl 52, and in a hole 62 made in a turned-out end of bar 54. It is easily seen that any pivoting of bar 54 results in the shearing of the conductor 46 at the level of the holes 60 and an interruption of the safety line. The conductor 46 is threaded in the same manner in the detector 50, while being fixed in the intermediate sections to detectors 44, 48, 50 to side plates 34 and to beam 40 with a slack permitting limited movements during the normal working of the installation.

The detector device works in the following manner:

During normal working, rockers 10, 12, 14 pivot only slightly, and the flexibility and the slack allow these limited movements. An accidental breaking, for example of the spindle of sheave 20 of rocker 12 and the falling of this sheave would on the contrary cause a considerable clockwise pivoting of the rocker under the thrust of cable 42 bearing on sheave 22, into the position shown by a dotted line in FIG. 4.

The pawl 52 accompanies side plate 24 in its swinging movement while the bar 54, held back by conductor 46, pivots in relation to pawl 52, and sections the conductor 46 passing through holes 60.

The length of the bar 54 forming a lever, defines the sectioning force and is selected accordingly. The conductor 46 can also be broken by the traction exerted by the rocker upon pivoting.

The loss of sheave 22 causes in a similar manner the pivoting upwards of the rocker and the shearing of conductor 46, so as to stop the installation. The detectors 48, 50 monitor rockers 12, 14, the pivoting of rocker 10 being monitored by the derailment detector 44, but it is clear that rocker 10 can also be equipped with a shearing detector of the type described above in replacement of or in addition to the brittle bar detector. The device reacts also to the loss of a rocker 12, 14, for example due to the breaking of a spindle 30, 32 and to a derailment of the cable, the rocker out of balance pivoting and sectioning conductor 46.

The shearing device may obviously be of a different design, for example with a positive control of bar 54, which in this case acts in conjunction with a stop or a holding component different from the conductor 46. Such a system necessitates an adjustment or an adaptation to the rocker that is easily made, but avoided for the standard device illustrated by FIGS. 1 to 4. This latter device may be mounted without any modification on existing installations.

The interruptions of the safety line by the excessive pivoting of a rocker may also result from a simple breakage of conductor 46, fixed to the mobile elements, in particular to the ends of the rockers, to allow limited pivoting, but sufficiently taunt to be broken by an excessive pivoting of a rocker.

Figure 5:
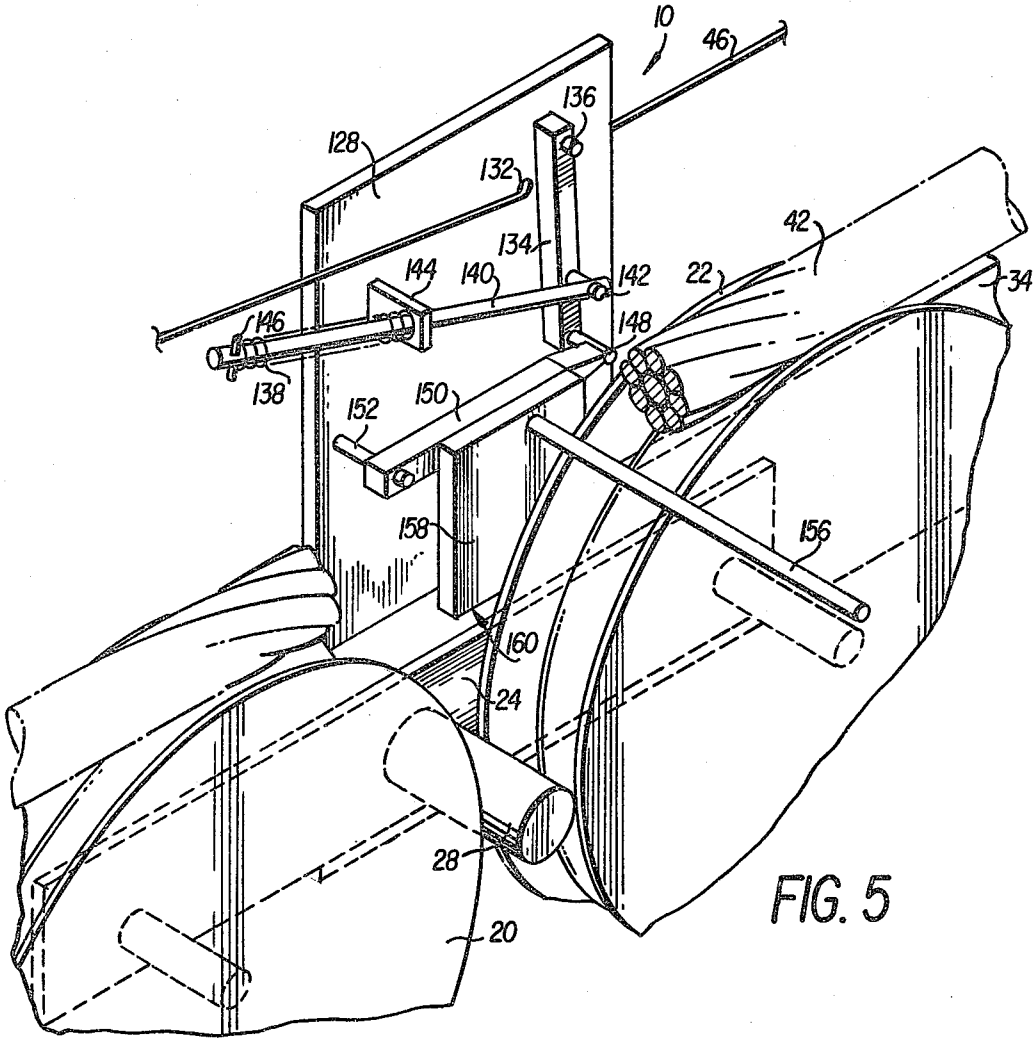
FIG. 5 is a view in perspective of a variant in the realization.
Figure 6:
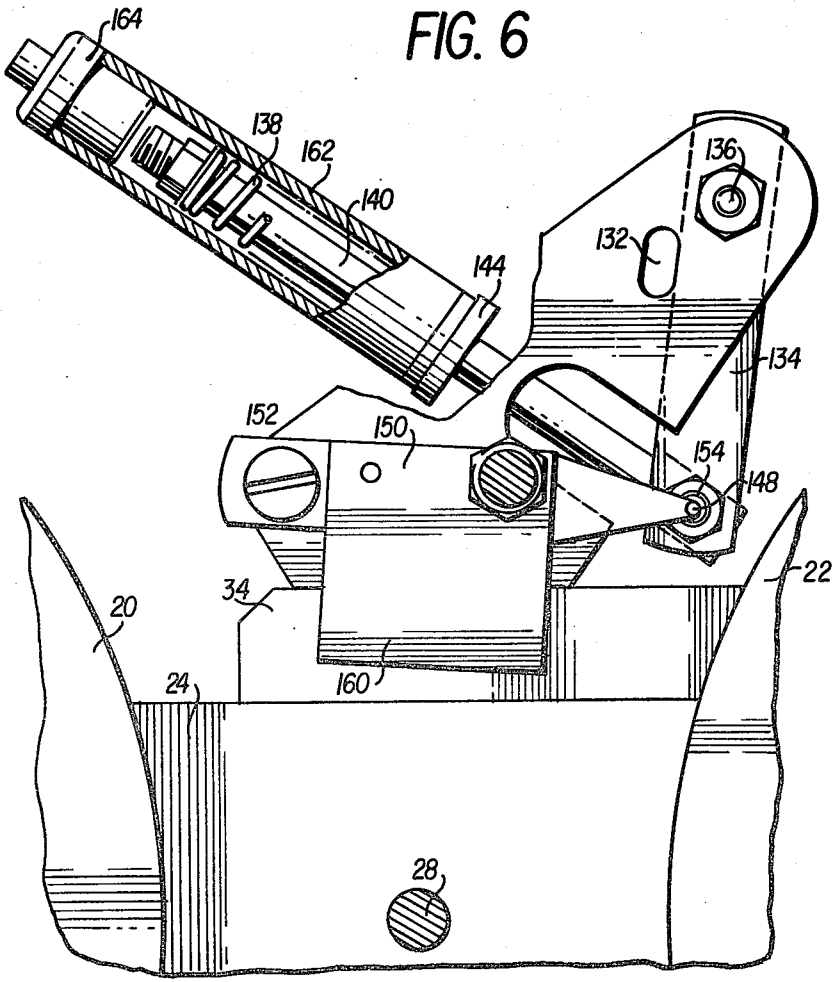
FIG. 6 is a view in elevation of a mode of realizing the variant in FIG. 5.

FIGS. 5 and 6 show a detector according to the invention, which advantageously replaces brittle bar detector and/or the shear detectors 48. To one of the main side plates 34 is fixed, for example by welding, the support plate 128 of a means of shearing the safety line 46 of the installation. The conductor of line 46 passes through a hole 132 in the plate, which works in conjunction with a shear 134, mounted so as to rotate on a spindle 136 carried by the plate, and able to pivot so as to move in front of hole 132, sectioning conductor 46. The shear 134 is pulled into the shearing position by a compression spring 138 threaded on to the end of a rod 140 articulated on a spindle 142 carried by shear 134 and sliding through a hole made in a stop 144. The compression spring 138 is inserted between the stop 144 and a pin 146 inserted in the rod 140. The shear 134 has on its end a pawl 148 able to work in conjunction with a latch system formed by a pivoting lever articulated on a fixed spindle 152. The end of the latch system 150 is formed in a hollow 154 of slight depth housing pawl 148, so as to establish a stable latching position, lever 150 extending appreciably perpendicular to shear 134.

It is easily seen that the latch may be freed by pivoting lever 150 upwards or downwards to dislodge pawl 148 from hollow 154. The latching 150 being freed, the shear is rapidly displaced under the action of spring 138 into the position in which the line 46 is sectioned.

To lever 150 are fixed in the first place a rod 156 extending under cable 42 and between sheaves 20, 22 and in the second place a plate 158 the lower edge 160 of which is in the proximity of side plate 34. It is easily seen that the falling of the cable 42 on rod 156 causes the pivoting downwards of lever 150 and the unlatching of the shear 134. In a similar manner an excessive pivoting of the rocker 10 causes this to thrust against surface 160 of plate 158 and the pivoting of lever 150 thus freeing the latch.

A spring 138 with a force sufficient to section conductor 46 is chosen, and it is clear that the force for unlocking the safety device is appreciably smaller than and practically independent of the force of spring 138. This unlocking force depends essentially on the depth of hollow 150, which is chosen of sufficient depth to avoid any untimely tripping by the action of vibration during normal working.

Figure 7:
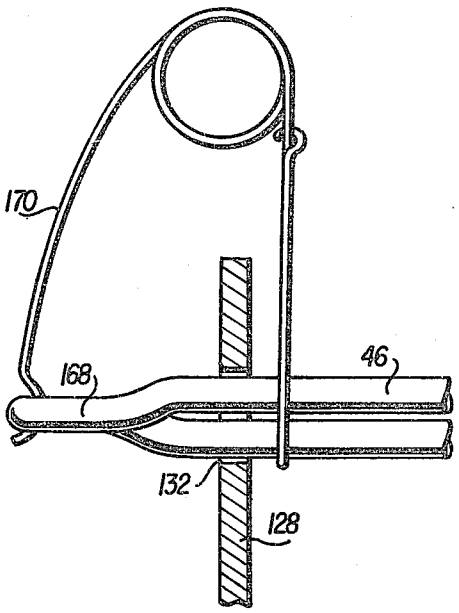
FIGS. 7 and 8 illustrate details of the realization.
Figure 8:
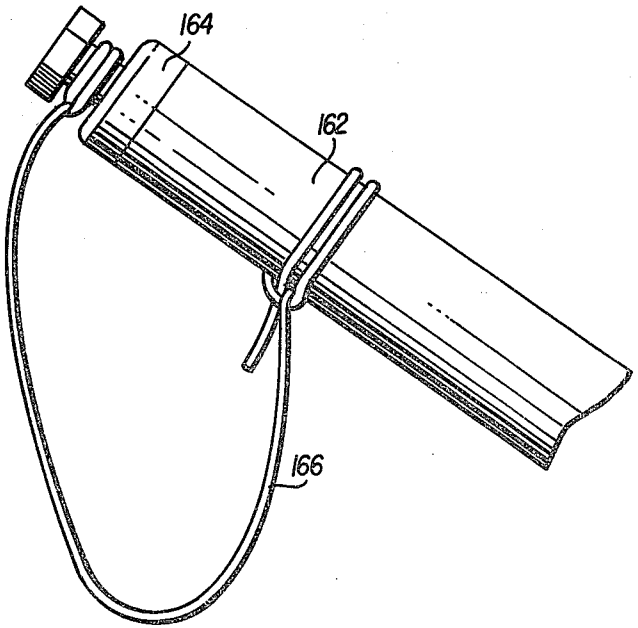

FIGS. 7 and 8 illustrate a mode of realization of the safety device in which the spring 138 is housed in a tube 162 with the end stopped by a plug 164. When the device functions, the rod 140 ejects the plug 164, which serves as an indicator of the functioning. It may be advantageous to retain the plug 164 by a string 166 allowing the person supervising the installation to see the ejected plug from a distance. Any other signalling device can of course be tripped by the spring 138 or the shear 134. The conductor 46 is advantageously inserted in the form of a loop 168 through hole 132, which facilitates the fitting, and if necessary the replacing of the conductor. This arrangement also facilitates the checking of the correct operation of the safety device by the simple withdrawal of the conductor 46 and possibly the replacement of this by an identical conductor not forming part of the line. Thus is avoided any sectioning of the safety line during tests and of course corresponding repairs. In FIG. 7 a hairpin shape spring 170 is shown. This pulls the loop 168 into a position remote from the conductor 46 and the plate 128. When this loop is sectioned the spring 170 separates it from the conductor 46, confirming the interruption of the line.

It is easily seen that this device is particularly simple and does not make use of any switch or brittle element connected with the safety line 46. Its sensivity can be adapted to the working conditions of these installations.

What is claimed is:

1. A transport installation having an overhead cable and a device for monitoring the components supporting the cable, comprising:

a train of successive rockers, each rocker having two cable support sheaves and a spindle on which it is articulated, a safety device to detect derailment of the cable or excessive movement of the rocker on the said spindle, said safety device having an electric line running along the installation and means for signalling an interruption of the electric line, wherein said electric line comprises a conductor wire inserted electrically in series in said line and running over the length of said train of rockers, and a plurality of sectioning shears each having two shanks pivoted together and working in conjunction with said conductor wire associated with each of the successive rockers of the said train, one of said shanks being fixed to the associated rocker and the other of said shanks being mechanically supported by said conductor wire, such that relative rotative movement between said shanks to actuate the shear and to section the conductor wire occurs in case of an excessive movement of the rocker, thereby to interrupt the safety line.

2. An installation in accordance with claim 1, wherein the conductor wire is fixed to the other of said shanks of the sectioning shear with sufficient slack for normal movements of the rockers and insufficient for excessive movement of any of the successive rockers, such that sectioning of the conductor occurs upon any such latter movement.

3. An installation in accordance with claim 1, having a hole through which passes the said conductor wire and a sectioning shear working in conjunction with the said orifice, a loop of the said conductor being inserted in the said hole so that said shear sections a length of the said conductor wire.

4. A transport installation having an overhead cable and a device for monitoring the components supporting the cable, comprising:

a train of successive rockers, each rocker having two cable support sheaves and a spindle on which it is articulated, a safety device to detect derailment of the cable or excessive movement of the rocker on the said spindle, said safety device having an electric line running along the installation and means for signalling an interruption of the electric line, wherein said electric line comprises a conductor wire inserted electrically in series in said line, and running over the length of said train of rockers, a plurality of sectioning shears, each said sectioning shear comprising a first element containing an aperture through which a loop of said conductor wire passes and an arm pivoted to said first element swingable past said aperture to section said wire loop, each rocker being associated with one of said sectioning shears and each shear further comprising an energy-accumulating spring biasing a link member connected to said arm in condition of pulling said arm past said aperture and means for latching said arm in an armed position preventing said arm from swinging past said aperture, said latching means having a component placed in the trajectory of the fall of the cable or the trajectory of excessive movement of the rocker to command the unlocking of said latching means upon falling of the cable onto said component or movement of the rocker against said component, for thereby releasing said arm and actuating said sectioning shear.

* * * * *